United States Patent [19]

Hirano et al.

[11] Patent Number: 4,646,688

[45] Date of Patent: Mar. 3, 1987

[54] COOLING SYSTEM FOR AUTOMOTIVE ENGINE OR THE LIKE

[75] Inventors: Yoshinori Hirano, Yokohama; Yoshimasa Hayashi, Kamakura, both of Japan

[73] Assignee: Nissan Motor Co., Ltd., Yokohama, Japan

[21] Appl. No.: 802,358

[22] Filed: Nov. 27, 1985

[30] Foreign Application Priority Data

Nov. 28, 1984 [JP] Japan ..... 59-252673
Apr. 12, 1985 [JP] Japan ..... 60-78167

[51] Int. Cl.[4] ..... F01P 3/22; F01P 7/14
[52] U.S. Cl. ..... 123/41.27; 123/41.44
[58] Field of Search ..... 123/41.2–41.27, 123/41.44

[56] References Cited

U.S. PATENT DOCUMENTS

| | | | |
|---|---|---|---|
| 1,787,562 | 1/1931 | Barlow | 123/41.44 |
| 4,367,699 | 1/1983 | Evans | 123/41.49 |
| 4,425,766 | 1/1984 | Claypole | 236/35 |
| 4,545,335 | 10/1985 | Hayashi | 123/41.27 |
| 4,549,505 | 10/1985 | Hirano | 123/41.27 |
| 4,553,505 | 11/1985 | Hirano et al. | 123/41.79 |
| 4,559,907 | 12/1985 | Hayashi | 123/41.44 |
| 4,565,162 | 1/1986 | Seki et al. | 123/41.21 |
| 4,567,858 | 2/1986 | Hayashi | 123/41.21 |

FOREIGN PATENT DOCUMENTS

| | | | |
|---|---|---|---|
| 32025 | 4/1981 | Japan | 123/41.21 |

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to rapidly bring the temperature of the coolant in the coolant jacket of an evaporative type cooling system to a derived target value, both the rate of heat exchange between the condenser or radiator of the system and the surrounding ambient atmospheric air and the amount of coolant in the cooling circuit are varied in a manner to change the pressure and therefore the boiling point of the coolant. With the invention coolant is positively pumped to and from a reservoir which is maintained at atmospheric pressure, into and out of a cooling circuit which is hermetically sealed during engine operation via a valve and conduit arrangement which includes only two electromagnetic valves and associated conduits. A reversible pump is utilized to pump the coolant to and from the reservoir. The coolant is permitted to pass unrestrictedly through the pump when the pump is not operating due to a pressure differential between the cooling circuit and the reservoir.

7 Claims, 19 Drawing Figures

SYSTEM CONTROL ROUTINE

NON-CONDENSIBLE MATTER PURGE CONTROL ROUTINE

TEMPERATURE CONTROL ROUTINE

COOLANT LEVEL CONTROL ROUTINE

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which features a simple valve and conduit arangement and which enables rapid control of pressure prevailing in the cooling circuit thereof so as to offset any undesirable effects on temperature control that sudden changes in ambient conditions might have and which further prevents the intrusion of contaminating air and/or the like non-condensible matter.

2. Description of the Prior Art

In currently used 'water cooled' internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of otherwise useful horsepower.

FIG. 2 shows an arrangement disclosed in Japanese Patent Application Second Provisional Publication No. Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of 'embolism' in the radiator and which badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proved totally unsatisfactory in that upon boiling of the liquid coolant absorbed into the cramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in copending United States patent application Ser. No. 663,911 filed on Oct. 23, 1984 in the name of Hirano. The disclosure of this application is hereby incorporated by reference thereto.

This arrangement while overcoming the problems inherent in the above discussed prior art suffers from the drawback of being overly complex in that a plurality of valves and conduits (valves 134, 152, 156 and 170 and conduits 150, 154 and 168) are required to execute the intended control thereof and further in that, even though provision is made to control the coolant boiling point by varying both the cooling effect provided by the fan 127 and the amount of coolant in the condensor or radiator 126, still the response to sudden changes in ambient conditions has been overly sluggish and thus has exhibited an unacceptable degree of oversensitivity to extenal influences.

For convenience the same numerals as used in the above mentioned patent application are also used in FIG. 7.

SUMMARY OF THE PRESENT INVENTION

It is an object of the present invention to provide a cooling system for an internal combustion engine or the like device which permits liquid coolant to boil and uses the vapor generated as a vehicle for removing heat from the engine and which features a simple construction which controls the pressure prevailing in the system by positively pumping coolant into or out of the cooling circuit thus ensuring rapid response to sudden deviations in the boiling point from the desired value.

In brief, the above mentioned objects is achieved by an arrangement wherein in order to rapidly bring the temperature of the coolant in the coolant jacket of an evaporative type cooling system, to a variable target value, both the rate of heat exchange between the condenser (or radiator of the system) and the surrounding ambient atmospheric air and the amount of coolant in the cooling circuit are varied in a manner to change the pressure and therefore the boiling point of the coolant; and which features an arrangment having only two electomagnetic valves which enables coolant to be positively pumped to and from a reservoir maintained at atmospheric pressure, into and out of a cooling circuit which is hermetically sealed during engine operation and for coolant to be inducted under the influence of a pressure differential between the interior of the cooling system and the reservoir.

More specifically, a first aspect of the the present invention takes the form of an internal combustion engine having a structure subject to high heat flux; a cooling circuit for removing heat from the engine comprising: (a) a coolant jacket formed about the structure, the coolant jacket being arranged to receive coolant in liquid form and discharge same in gaseous form, (b) a radiator in which the gaseous coolant produced in the coolant jacket is condensed to its liquid form, and (c) a vapor transfer conduit leading from the coolant jacket to the radiator for transfering gaseous coolant from the coolant jacket to the radiator; a device associated with the radiator for varying the rate of heat exchange between the radiator and a cooling medium surrounding the radiator; a liquid coolant return conduit leading from the radiator to the coolant jacket for returning coolant condensed to its liquid state in the radiator to the coolant jacket; a reservoir the interior of which is maintained constantly at atmospheric pressure; valve and conduit means for selectively interconnecting the reservoir and the cooling circuit, the valve and conduit means including a three-way valve disposed in the return conduit and a level control conduit leading from the three-way valve to the reservoir, the three-way valve having a first state wherein fluid communication between the radiator and the coolant jacket is interrupted and communication between the radiator and the reservoir established, and a second state wherein communication between the reservoir and the radiator is interrupted and communication between the radiator and the coolant jacket established; a reversible pump disposed in the coolant return conduit at a location between the radiator and the three-way valve, the pump being selectively energizable to pump coolant in (a) a first flow direction from the radiator toward the three-way valve and (b) in a second flow direction from the three-way valve toward the radiator; means for permitting liquid coolant to pass unrestrictedly through the pump when the pump is not pumping; a first sensor for sensing a parameter which varies with the temperature of the liquid coolant in the coolant jacket; a second sensor for sensing a parameter which varies with the load on the engine; and a control circuit responsive to the first and second sensors for controlling the operation of the device, the valve and conduit means and the pump, the control circuit including means for: determining the operational mode of the engine; deriving a target temperature at which the liquid coolant in the coolant jacket should be maintained; operating the device in a manner to vary the rate of condensation in the radiator and bring the temperature of the coolant in the coolant jacket to the target temperature, operating the three-way valve in a manner to establish fluid communication between the reservoir and the cooling circuit when the engine is stopped and the temperature of the coolant in the cooling circuit is below a predetermined level, so that liquid coolant can be inducted from the reservoir into the cooling circuit via the permitting means, and so that liquid coolant can be displaced from the cooling circuit to the reservoir via the permitting means when the engine is warming up after being started, and operating the three-way valve and the pump in a manner to vary the amount of coolant in the cooling circuit and therefore modify the pressure prevailing in the cooling circuit in a manner which tends to being the temperature of the coolant to the target temperature.

A further aspect of the invention comes in a method of cooling an internal combustion engine comprising the steps of: introducing liquid coolant into a cooling circuit which includes a coolant jacket formed about structure of the engine subject to high heat flux; permitting the coolant in the coolant jacket to boil and produce coolant vapor; transferring the coolant vapor to a radiator which defines a further section of the cooling circuit; condensing the coolant to its liquid form in the radiator; sensing operational parameters of the engine; sensing the temperature of the coolant in the coolant jacket; using the data obtained during the step of sensing operational paramters to derive a target temperature at which the coolant in the coolant jacket should be maintained under the instant set of operational conditions; using a device located externally of the radiator to vary the rate of heat exchange between the radiator and a cooling medium surrounding the radiator in a manner which tends to bring the temperature of the coolant to the target temperature; using a reversible pump to pump coolant into and out of the coolant circuit in a manner which varies the pressure prevailing in the cooling circuit in a manner which tends to bring the temperature of the coolant to the target temperature; storing liquid coolant in a reservoir; and permitting liquid coolant to pass unrestrictedly through the reversible pump from the reservoir to the cooling circuit and vice versa under the influence of a pressure differential which exists betwen the cooling circuit and the reservoir when the pump is not pumping.

An outstanding feature of the present invention invention comes in the simplicity of the valve and conduiting arrangement which provides fluid communication between the reservoir and the cooling cirucit of the system. Viz., the valve and conduiting requires only two electromagnetic valves and two corresponding conduits to execute all of the coolant management control needs. This feature is enabled by the use of a pump which permits coolant to flow freely therethrough when not operating.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the concepts on which the present invention is based.

Figure 1:
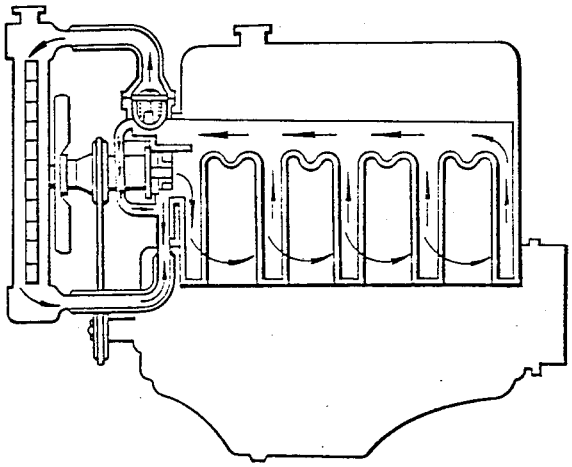
FIG.1 (PRIOR ART)
FIG. 1 is a partially sectioned elevation showing the conventional water circulation type cooling system discussed in the opening paragraphs of the instant disclosure.
Figure 2:
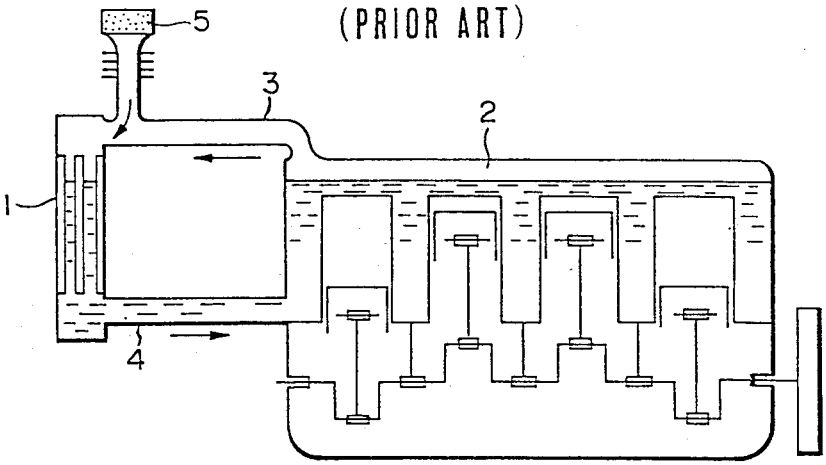
FIG.2 (PRIOR ART)
FIG. 2 is a schematic side sectional elevation of a prior art arrangement also discussed briefly in the earlier part of the specification.
Figure 3:
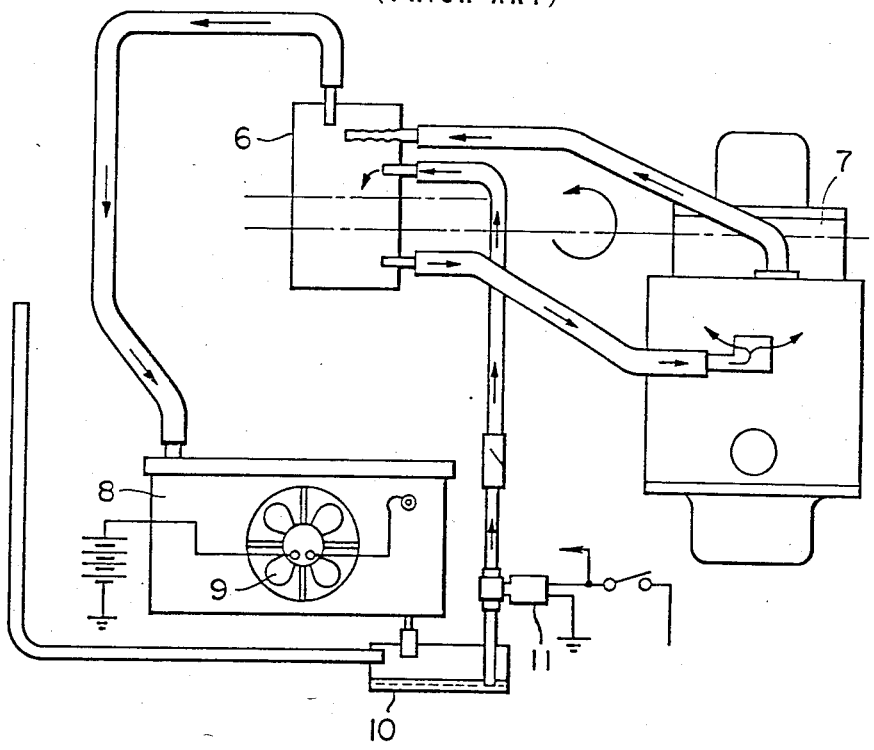
FIG.3 (PRIOR ART)
FIG. 3 shows in schematic layout form, another of the prior art arrangements previously discussed.
Figure 4:
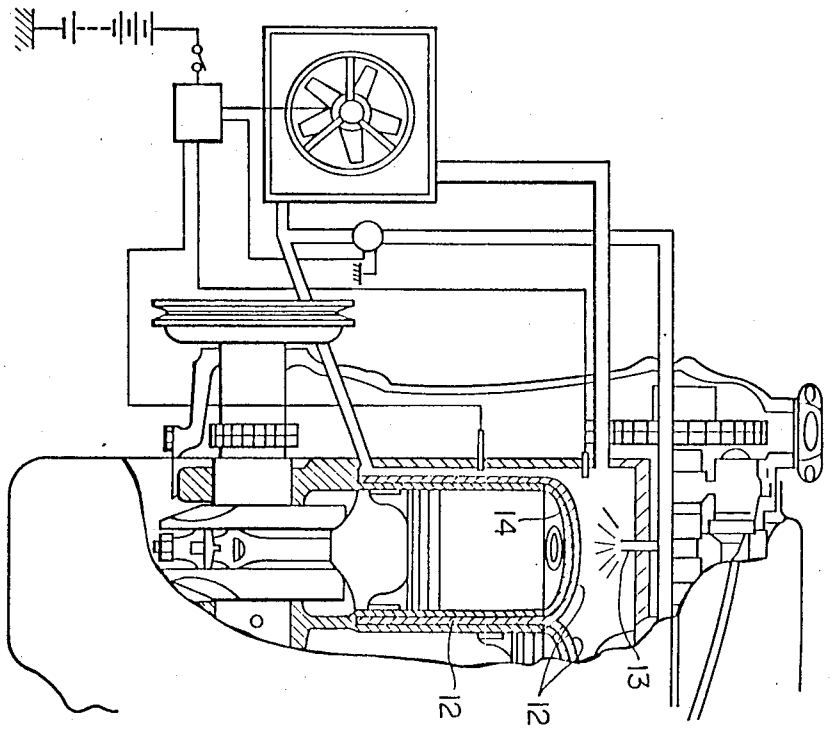
FIG.4 (PRIOR ART)
FIG. 4 shows in partial section yet another of the previously discussed prior art arrangements.
Figure 5:
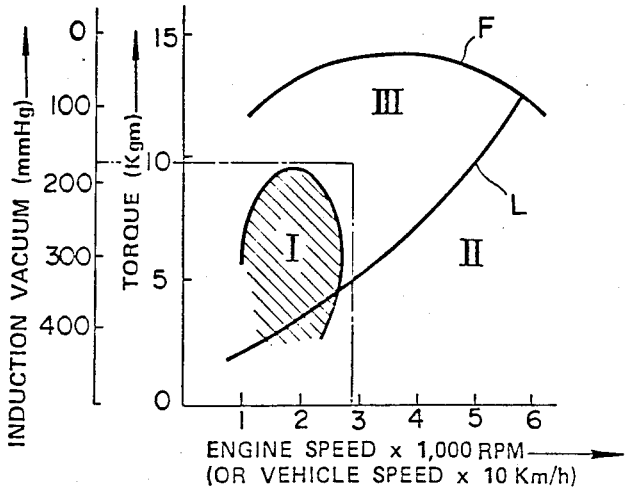
FIG. 5 is a graph showing in terms of induction vacuum (load) and engine speed the various load zones encountered by an automotive internal combustion engine.
Figure 6:
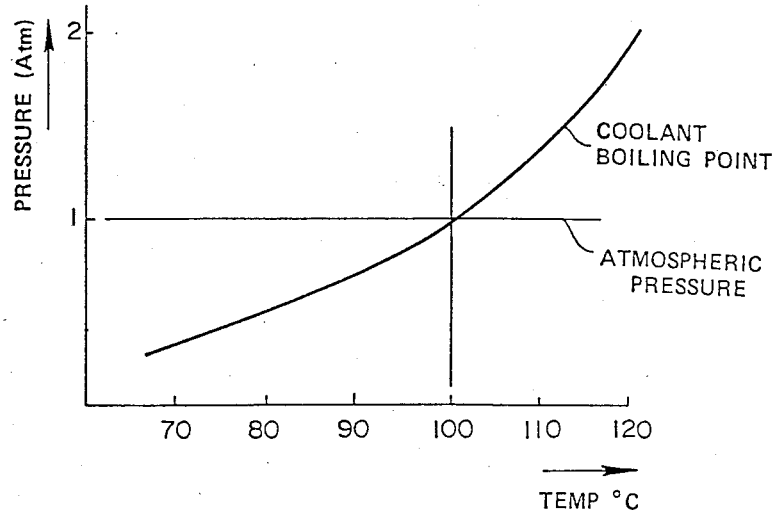
FIG. 6 is a graph showing in terms of pressure and temperature, the change which occurs in the coolant boiling point with change in pressure.

FIG. 5 graphically shows in terms of engine torque and engine speed the various load 'zones' which are encountered by an automotive vehicle engine. In this graph, the curve F denotes full throttle torque characteristics, track L denotes the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°–80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C. if so desired.

Figure 7:
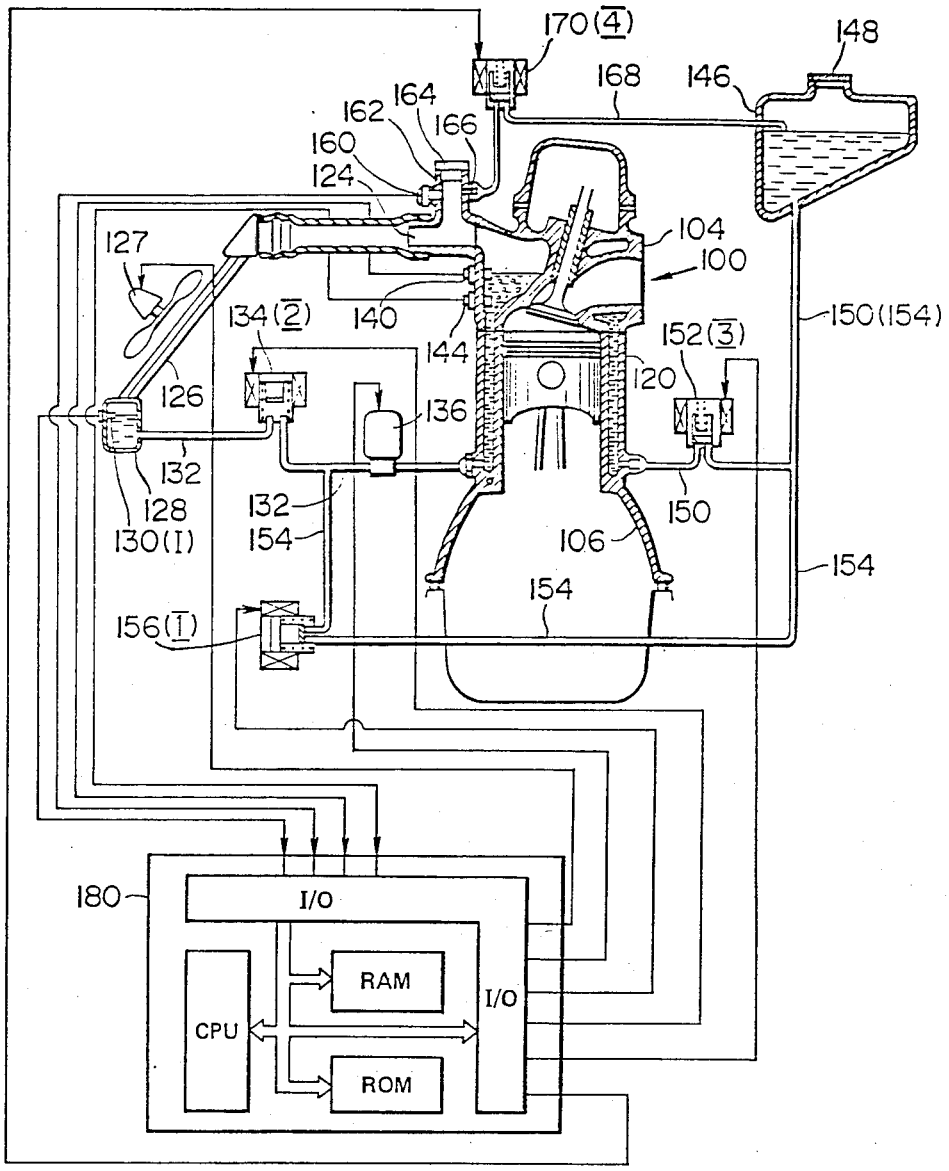
FIG. 7 shows in schematic elevation the arrangement disclosed in the opening paragraphs of the instant disclosure in conjunction with copending U.S. Ser. No 663,911.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant, rises if the system employed is of the closed circuit type. Thus, during urban cruising by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres). In addition to the control afforded by the air circulation the present invention is arranged to positively pump coolant into the system so as to vary the amount of coolant actually in the cooling circuit in a manner which modifies the pressure prevailing therein. The combination of the two control enables the temperature at which the coolant boils to be quickly brought to and held close to that deemed most appropriate for the instant set of operation conditions.

On the other hand, during high speed cruising, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. In addition to this, the present invention also provides for coolant to be positively pumped out of the cooling circiut in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendancy for air to find its way into the interior of the cooling circuit becomes excessively high and it is desirable under these circumstances to limit the degree to which a negative pressure is permitted to develop. The present invention controls this by either positively pumping coolant into the cooling circuit while it remains in an essentially hermetically sealed state and raises the pressure in the system to a suitable level or allowing the inherent pressure differential between the interior of the cooling circuit and the reservoir to induce a similar effect.

Figure 8:
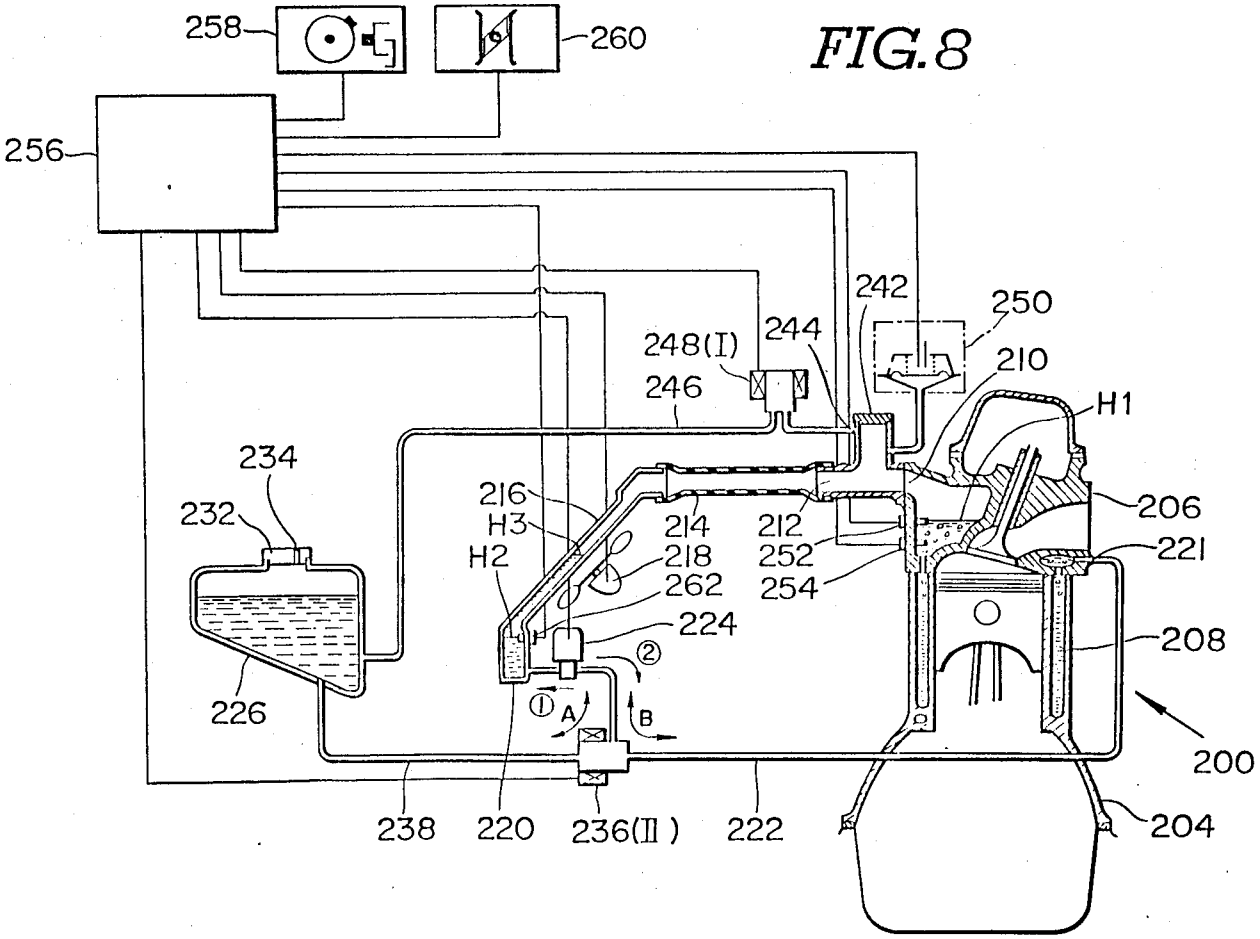
FIG. 8 shows in sectional elevation a first embodiment of the present invention.

FIG. 8 of the drawings shows a first embodiment of the present invention. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condensor 216 or radiator as it will be referred to hereinafter. Located adjacent the raditor 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinlater, is provided at the bottom of the radiator 216 and arranged to collect the condensate produced therein. Leading from the lower tank 220 to a coolant inlet port 221 formed in the cylinder head 206 is a coolant return conduuit 222. A small capacity electrically driven pump 224 is disposed in this conduit at a location relatively close to the radiator 216. According to the present invention, this pump 224 is arranged to reversible—that is energizable so as to induct coolant from the lower tank 220 and pump same toward the coolant jacket 208 (viz., pump coolant in a first flow direction) and energizable so as to pump coolant in the reverse direction (second flow direction)—i.e. induct coolant through the return conduit 222 and pump it into the lower tank 220. Further, this pump is provide with means for permitting liquid coolant to pass unrestrictedly therethrough when the pump is not energized to pump in one of the first and second flow directions. This means may take the form of a by-pass passage formed in the pump itself and some arrangement for ensuring that the pump once energized does not undergo a loss of efficiency due to the presence of the by-pass. Alternatively, the pump may be so desiged as to permit the free passage of coolant without the need for valves and by-pass passages or the like. E.g. a kind of centrifugal pump or the like.

This particular arrangement eliminates the need for a separate valve and conduit for permitting coolant to readily displaced from or inducted into the the cooling circuit during shut-down and or during warm-up phases of operation. These modes and the simplification of the system which is possible with the above mentioned design will become clearer as the discussion of the operation of the system unfolds hereinlater.

A coolant reservoir 226 is disposed in close proximity of the engine and the radiator 216. In the embodiments shown in FIGS. 8 and 19 the reservoir is shown at a level essentially equal to that of the section of the coolant jacket 208 formed in the cylinder block 204. However, if desired it is possible to arrangement the same at a higher position so as to take advantage of any head pressure that a gravity feed arrangement may provide. The location of the reservoir with the respect to the engine is not particulary critical and thus can be disposed in a suitable location with the the engine room or the like of an automtive vehicle in the instance that the present invention is utilized in such an environment.

The reservoir 226 is closed by a cap 232 in which a air bleed 234 is formed. This permits the interior of the reservoir 226 to be maintained constantly at amospheric pressure.

A three-way valve 236 is disposed in the coolant return condiut 222 and arranged to communicate with the reservoir 226 via a level control conduit 238. This valve is arranged to have a first (de-energized) state wherein fluid communication is established between the pump 224 and the reservoir 226 (viz., flow path A) and a second (energized) state wherein communication between the pump 224 and the coolant jacket 208 is established (viz., flow path B).

The vapor manifold 212 is formed with a riser portion 240. This riser portion 240 as shown, is provided with a cap 242 which hermetically closes the same and further formed with a purge port 244. This latter mentioned port 244 communicates with the reservoir 226 via an overflow conduit 246. This port should is arranged at the highest possible location in the cooling circuit so as to ensure that any air in the system will be removed therethrough.

A normally closed ON/OFF type electromagnetic valve 248 is disposed in conduit 246 and arranged to be open only when energized. If desired this valve can be arranged so that the valve element thereof can be moved to an open position upon a predetermined maximum permissible pressure prevailing in the system and thus also function as an emergency relief valve.

Also communicating with the riser 240 is a pressure differential responsive diaphragm operated switch arrangement 250 which assumes an open state upon the pressure prevailing within the cooling circuit (viz., the coolant jacket 208, vapor manifold 214, vapor conduit 214, radiator 216 and return conduit) dropping below atmospheric pressure by a predetermined amount. In this embodiment the switch 250 is arranged to open upon the pressure in the cooling circuit falling to a level in the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or 'hot spots'.

Located below the level sensor 252 so as to be immersed in the liquid coolant is a temperature sensor 254. The output of the level sensor 252 and the temperature sensor 254 are fed to a control circuit 256 or modulator which is suitably connected with a source of EMF (not shown).

It should be noted that it is advantageous to use a relatively simple temperature sensor such as a thermistor or the like and to immerse the same in the coolant in close proximity of the cylinder head (viz., structure subject to high heat flux) This enables a sensitive yet stable technique of determining the temperature of the coolant. While it is possible to use a pressure sensor which is located above level H1 for example, the output of such a sensor tends to be unstable as it is subject to pressure pulsations and the like produced by the bumping and frothing of the coolant which tends to occur under high engine load operation.

The control circuit 256 further receives an input from the engine distributor 258 (or like device) which outputs a signal indicative of engine speed and an input from a load sensing device 260 such as a throttle valve position sensor. It will be noted that as an alternative to throttle position, the output of an air flow meter or an induction vacuum sensor may be used. In the event that the engine to which the invention is applied is fuel injected it is possible to use the frequency of the injection control signal as an engine speed signal and the width of the pulses as an indication of engine load.

A second level sensor 262 is disposed in the lower tank 220 at a level H2. The purpose for the provision of this sensor will become clear hereinafter when a discussion the operation of the embodiment is made with reference to the flow charts of FIGS. 9 to 18

Prior to use the cooling circuit is filled to the brim with coolant (for example water or a mixture of water and antifreeze or the like) and the cap 242 securely set in place to seal the system. A suitable quantity of additional coolant is also placed in the reservoir 226.

When the engine is started, as the coolant jacket is completely filled with stagnant coolant, the heat produced by the combustion in the combustion chambers cannot be readily released via the radiator 216 to the ambient atmosphere and the coolant rapidly warms and begins to produce coolant vapor. At this time valve 236 is left de-energized (viz., in a state wherein flow path A is established) whereby the pressure of the coolant vapor displaces liquid coolant out of the cooling circuit (viz., the coolant jacket 208, vapor manifold 212, vapor conduit 214, radiator 216, lower tank 220 and return conduit 222) via lower tank 220, three-way valve 236 and conduit 238.

During this 'coolant displacement mode' it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H2 before that in the coolant jacket reaches H1), valve 236 is temporarily energized to esablish flow path B and an amount of the excess coolant in the coolant jacket 208 allowed to 'distill' over to the radiator 216 before valve 236 is conditioned to re-establish flow path A.

Alternatively, if the level H1 is reached first, level sensor 252 induces the energization of pump 224 and coolant is pumped from the lower tank 220 to the coolant jacket 208.

During this displacement mode, the load and other operational parameters of the engine (viz., the outputs of the sensors 258 and 260) are sampled and a decision made as to the temperature at which the coolant should be controlled to boil. If the desired temperature is reached before the amount of the coolant in the cooling circuit is reduced to its minimum permissible level (viz., when the coolant in the coolant jacket and the radiator are at levels H1 and H2 respectively) it is possible to energize valve 236 so that flow path A is established and the cooling circuit placed in a hermetically closed condition.

If the temperature at which the coolant boils should exceed that determined to be best suited for the instant set of engine operational conditions by a relatively large margin, three-way valve 236 may be set to establish flow path A and the pump 224 energized briefly to pump a quantity of coolant out of the cooling circuit to increase the surface 'dry' (internal) surface area of the radiator 216 available for the coolant vapor to release its latent heat of evaporation and to simultaneously lower the pressure prevailing within the cooling circuit. It should be noted however, that upon the coolant in the circuit being reduced to the minimum level (viz., when the levels in the coolant jacket 208 and the lower tank 220 assumes levels H1 and H2 respectively) the displacement of coolant from the circuit is terminated in order to prevent a possible shortage of coolant in the coolant jacket 208.

On the other hand, should the ambient conditions be such that the rate of condensation in the radiator 216 is higher than that desired (viz., overcooled) and the pressure within the system overly lowered to assume a subatmospheric level (for example), three-way valve 236 is conditioned to produce flow path A and the pump 224 operated to induct coolant from the reservoir 226 and force same into the radiator 216 via the lower tank 220 until it reaches level H3 (by way of example). With this measure, the pressure prevailing in the cooling circuit is raised and the surface area available for heat exchange reduced. Accordingly, the boiling point of the coolant is immediately modified by the change in internal pressure while the amount of heat which may be released from the system reduced. Accordingly, it is possible to rapidly elevate the boiling point to that determined to be necessary.

When the engine 200 is stopped it is advantageous to maintain valve 236 energized (viz., maintain flow path B) until the pressure differential responsive switch arrangement 250 opens and/or a predetermined period of time elapses. This obviates the problem wherein large amounts of coolant are violently discharged from the cooling circuit due to the presence of superatmospheric pressures therein.

The above briefly disclosed operation will become more clearly understood as the description of the the flow charts shown in FIGS. 9 to 18 proceeds. Although not shown in FIG. 8 it is to be understood that control circuit 256 includes a microprocessor of the nature shown in FIG. 7. Viz, the control circuit 256 includes a RAM, ROM, CPU and an I/O interface or interfaces.

SYSTEM CONTROL ROUTINE

Figure 9:
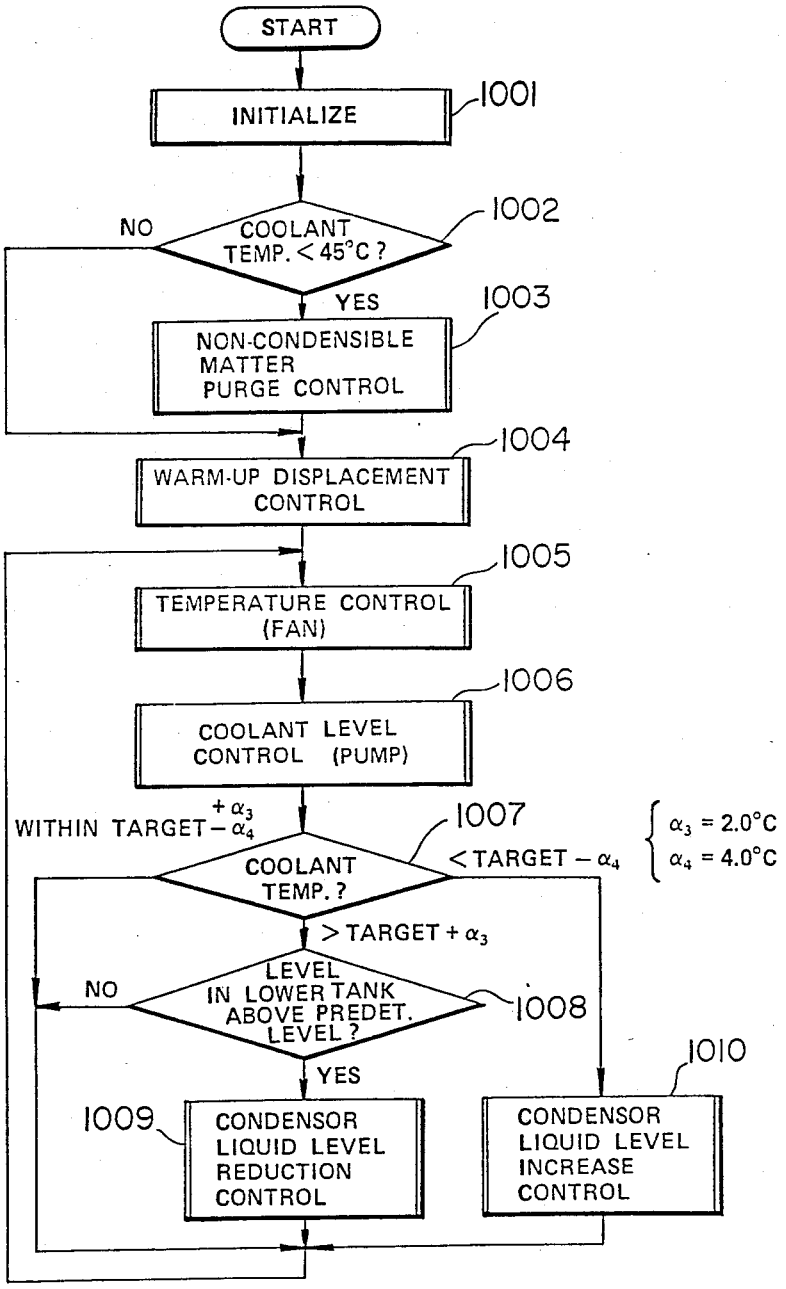
FIGS. 9 to 18 are flow charts depicting the steps which characterize the control of the arrangement shown in FIG. 8

FIG. 9 shows in flow chart form, the steps which characterize the control the system as a whole. As shown, at step 1001 of this routine the system is initialized (a detailed description of this will be given hereinlater with reference to FIG. 11). Following this the output of temperature sensor 254 is sampled and at step 1002 the determination made as to whether to proceed with the non-condensible matter purge routine or not is executed. As shown in this embodiment if the temperature of the coolant in the coolant jacket 208 is above 45° C. then the engine is deemed to be 'hot' and the purge routine (step 1003) by-passed and a warm up/displacement mode directly entered at step 1004. Viz., as the engine is still hot it is assumed that insufficient time has elapsed for any air to have leaked into the system.

Following the displacement mode a first temperature control mode is entered. Viz., a mode wherein the temperature of the coolant is controlled by varying the rate of heat exchange between the radiator 216 and the ambient atmosphere via selective energization of the cooling fan 218. At step 1006 the operation of the pump 224 is controlled in response to the output of level sensor 252 so as to maintain the cylinder head and other highly heated structure of the engine securely immersed in liquid coolant. Following this, the coolant temperature is ranged in step 1007 and control of the amount of the coolant actually contained in the cooling circuit of the system controlled (steps 1008 to 1010) in a manner to vary the pressure and hence the temperature at which the coolant will boil. Each of these routines will be discussed in detail hereinafter.

INTERRUPT ROUTINE

Figure 10:
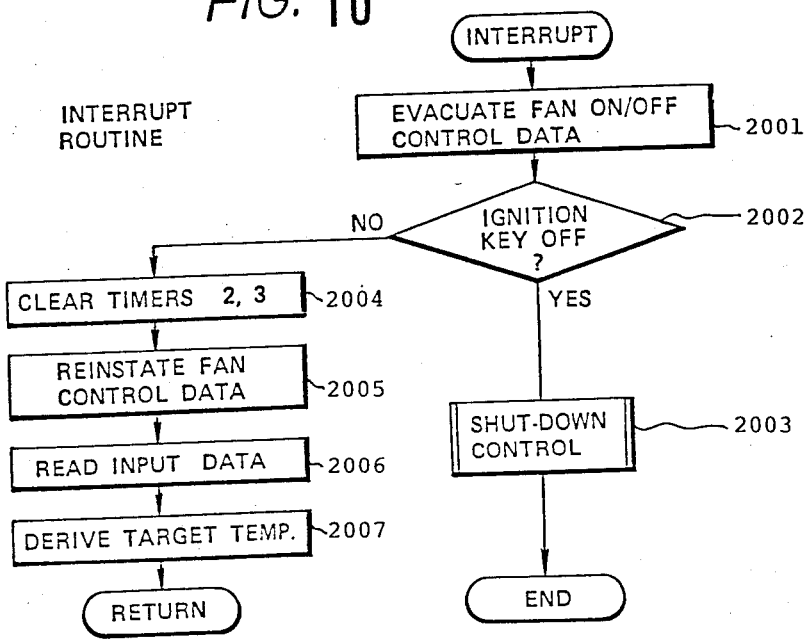

FIG. 10 shows an interrupt routine which is executed at predetermined frequent intervals and which determines the instant status of the engine. Viz., this routine frequently determines if the engine is running or not. If the engine is not running then a shut-down control is implemented while if the still operating various data are read and the optimum temperature (hereinlater referred to as TARGET temp.) at which the coolant should be controlled to, is determined.

It will be appreciated that immediately after the engine stops the heat which has accumulated in the engine structure cannot be released instantly and it is necessary let the engine cool for a given period and/or until superatmospheric pressures no longer prevail in the coolign circuit before rending the system open circuit and thus obviate (a) the possible loss of coolant from the system via violent displacment and subsequent spillage and (b) the possibility that air will find its way into the cooling system in relatively large quantities due to excessive loss of coolant.

As shown in FIG. 10 the first step of the interrupt routine is such as to evacuate the current fan on/off control data from the CPU and subsequently execute and enquiry (step 2002) as to the current engine status. This of course can be carried out by sampling the status of the engine igntion. Viz., if the ignition key is OFF then it can be assumed that control should flow into the shut-down routine (discussed hereinlater with reference to FIG. 18). On the other hand if the ignition key is still in the ON position then at step 2004 timers 2 and 3 are cleared, at step 2005 the evacuated fan control data is reinstated in the CPU, at step the current engine laod and rotational speed status is determined by sampling the outputs of sensors 258, 260 and at step 2007 the optimum coolant temperature determined and written into RAM.

As will be appreciated by those skilled in the art of computer programming. the above mentioned derivation can be executed in a number of ways. For example, it is possible to store a table of the nature of that shown in FIG. 5 of the drawingsin ROM, and by using the data from sensors 258 and 260 'look-up, which particular zone the engine is currently operating in and thus determine which temperature is best for the given circumstances. Alternatively, it is possible to devise a program which will calculate the desired temperature directly from the data available. As the various avenues for executing this derivation will be obvious to those skilled in this field no further description will be given for brevity.

INITIALIZATION

Figure 11:
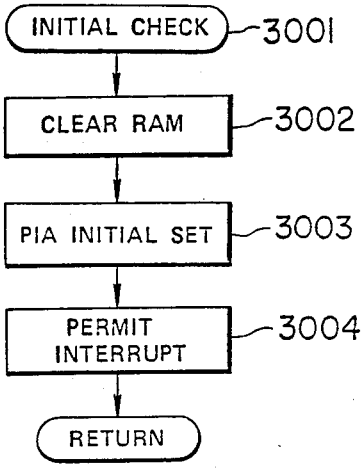

FIG. 11 shows in detail the steps which are conducted in the initialization step 1001 of FIG. 9. In this routine at step 3001 the initial check routine starts, at step 3002 the ram or rams of the mocroprocessor are cleared, as step 3003 the peripheral interface adapter is initially set, and in step 3004 the microprocessor is conditioned to allow interrupts.

NON-CONDENSIBLE MATTER PURGE CONTROL

Figure 12:
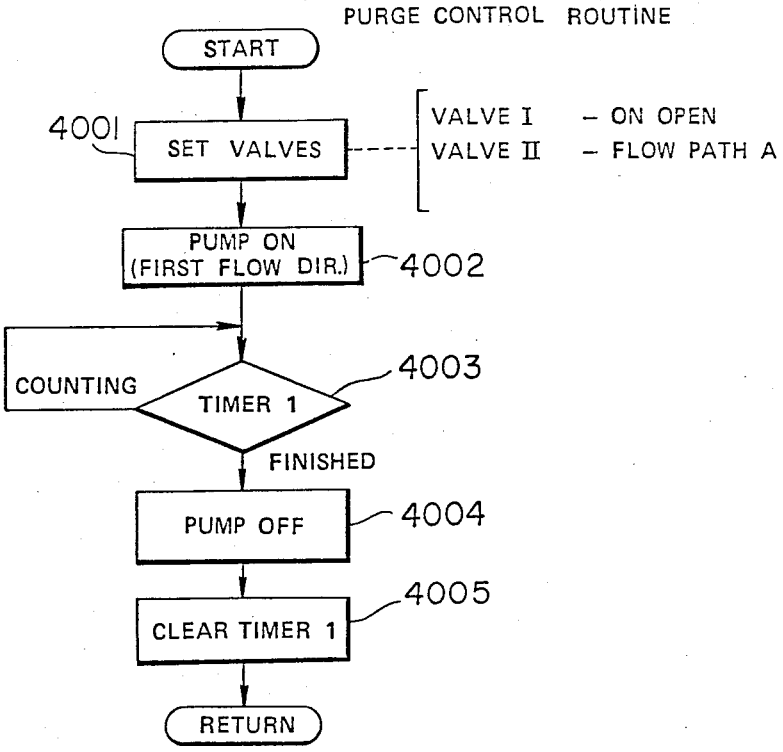

FIG. 12 shows the steps which characterize the control of the non-condensible matter purge mode. At step 4001 of this routine the two electromagnetic valves 248 and 236 are conditioned as shown. For the ease of explanation these valves shall be referred to simply as valves I and II. Viz. valve I (248) is energized so as to assume an open state and thus permit fluid communication between the riser 240 and the reservoir 226 via overflow conduit 246 while valve II (236) set so as to assume a condition wherein flow path A is established (viz., fluid communication between the reservoir 226 and the lower tank 220).

At step 4002 pump 224 is energized so as to pump coolant in the second flow direction (viz., toward the lower tank 220). This causes the freshly introduced coolant (from reservoir 226) to flow up through the radiator 216 toward the riser 240 and thus flush out any stubborn bubbles of air that may have found their way into the system and collected in the radiator tubing.

As the cooling circuit is essentially full at this time the excess coolant soon spills over to the reservoir 226 via the return conduit 246. The operation of pump 224 is maintained for a predetermined period of time (which can be set between several seconds and several tens of seconds—for example from 5 to 60 seconds) by a soft clock or first timer (timer 1) which arranged to count down by one per each run of the program, or alternatively by one each time a clock pulse or like signal is produced within the microprocessor in which the instant set of programs are being run. While this clock or timer is counting the program recycles to step 4003 as shown. Subseuently, upon the timer having counted down (or alternatively up) by the required amount the program flows on to step 4004 wherein the operation of the pump 224 is stopped and timer 1 (first timer) cleared ready for the next purge operation.

WARM-UP/DISPLACMENT CONTROL ROUTINE

Figure 13:
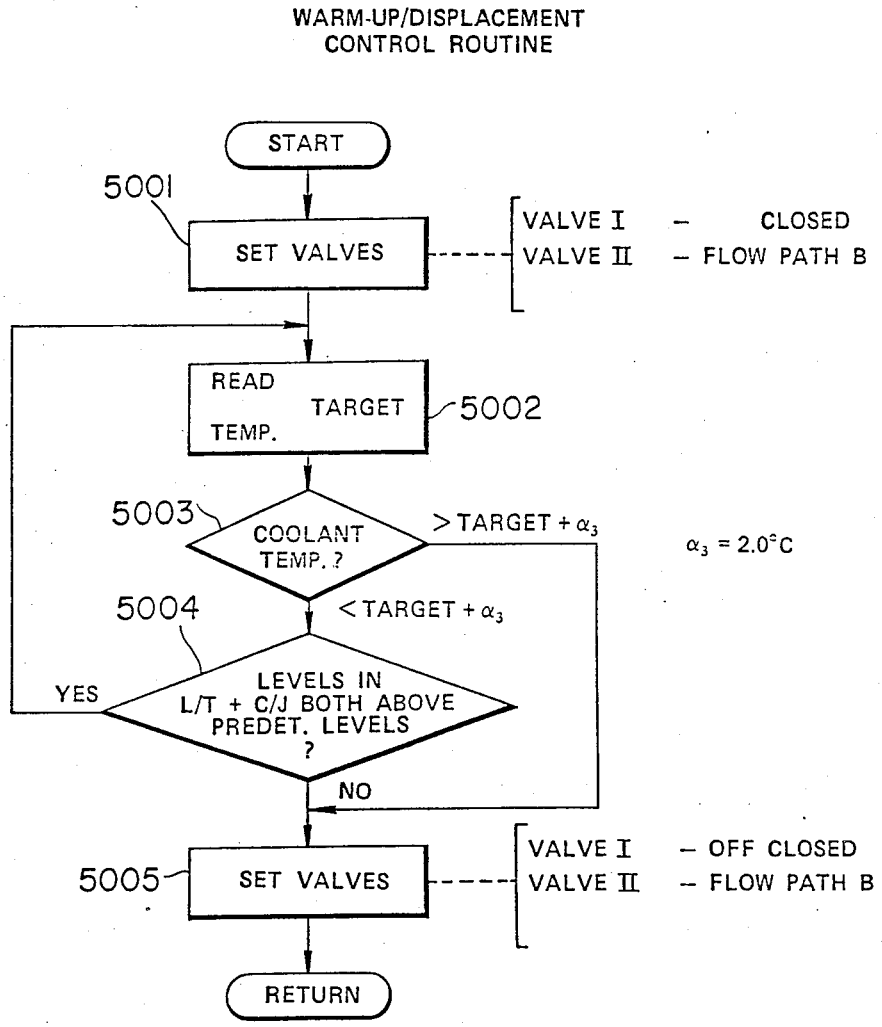

As shown in FIG. 13 step 5001 is such that valves I and II (i.e. valves 248 and 236) are conditioned in a manner which closes the overflow conduit 246 and establishes flow path B.

At step 5002 the current TARGET temperature value is read out of RAM. At step 5003 the output of the coolant temperature sensor 254 is sampled and compared with the TARGET value read out in step 5002. If the coolant temperature is above TARGET by a value $\alpha 3$ (wherein $\alpha = 2.0°$ C.) then the program flows to step 5005 while in the event that the coolant temperature has not come within TARGET+$\alpha 3$ then at step 5004 the output of level sensors 252 and 262 are sampled and it is determined if the level of coolant in both of the coolant jacket 208 (C/J) and the lower tank 220 (L/T) are below levels H1 and H2 respectively. If the outcome of this enquiry is negative, then the coolant circuit is assume to still contain an amount of coolant in excess of the above mentioned minimum amount and the program recycles to step 5002 to allow for further displacement. However, if one of the levels has reached the respective predetermined one, then in order to prevent either an excessively low level in the coolant jacket 208 or for the excess coolant in the coolant jacket to be in part moved to the radiator 216 via the previously mentioned 'distillation' process, the valves are conditioned as shown. Viz., valve I is closed and valve II conditioned to establish flow path B.

As will be appreciated as the pump 224 of the present invention is arranged to permit free passageof liquid therethrogh when not pumping, the coolant may be displaced out of the cooling circuit without the need for a separate conduit and electromagnetic valve. This of course permits a notable simplification in the system construction and reduces the number of conduits which must be arranged in the crowded engine room or compartment in which the engine engine is installed.

TEMPERATURE CONTROL ROUTINE

Figure 14:
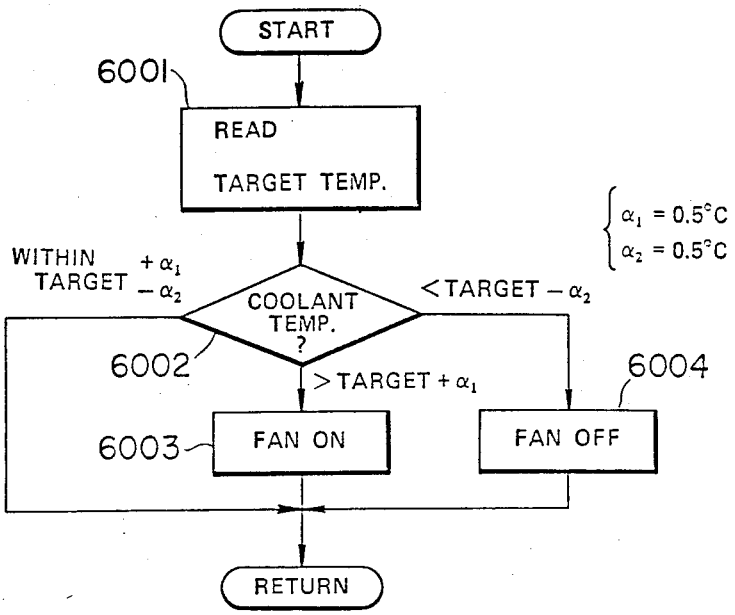

Following each run of the warm-up/ displacment control routine, the temperature control (fan) program is run. As shown in FIG. 14, at step 6001 of this routine the instant value of TARGETY is read out of RAM and at step 6002 the instant coolant temperature determined by sampling the output of temperature sensor 254 and compared with the instant TARGET value. The temperature is ranged as shown. If the instant coolant temperature is within a range of TARGET+a1 to TARGET−$\alpha 3$ (wherein $\alpha 1 = 0.5°$ C.$=\alpha 2$) then the routine terminates. However, if the temperature is lower than TARGET−$\alpha 2$ then the operation of the cooling fan 218 is prevented while if above TARGET+$\alpha 1$ then at step 6003 the operation of the fan 218 is induced.

COOLANT LEVEL CONTROL ROUTINE

Figure 15:
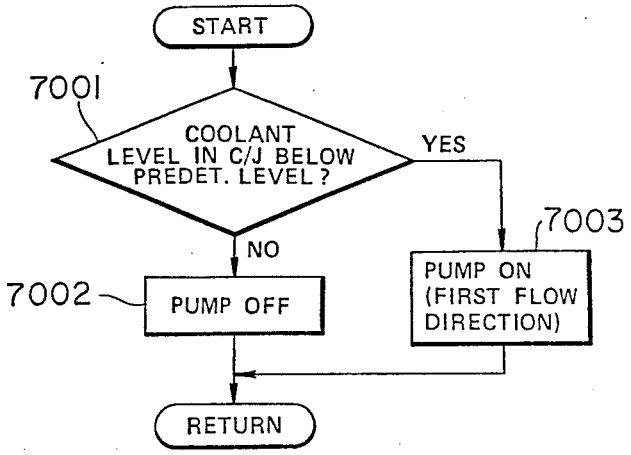

FIG. 15 shows the coolant level control routine which is run after each temperature control routine execution. At step 7001 of this program the level of the coolant in the coolant jacket 208 is determined by sampling the output of level sensor 252. If the level of coolant in the coolant jacket 208 (C/J) is below H1 then at step 7003 pump 224 is energized to pump colant in the first flow direction from the lower tank 220 toward the coolant jacket 208. The pump 224 is left running until the next run of the coolant level control routine which of course occurs within a very short period of time. When the coolant level has been returned to level H1 the operation of the pump is stopped in step 7002.

RADIATOR LEVEL REDUCTION CONTROL ROUTINE

Figure 16:
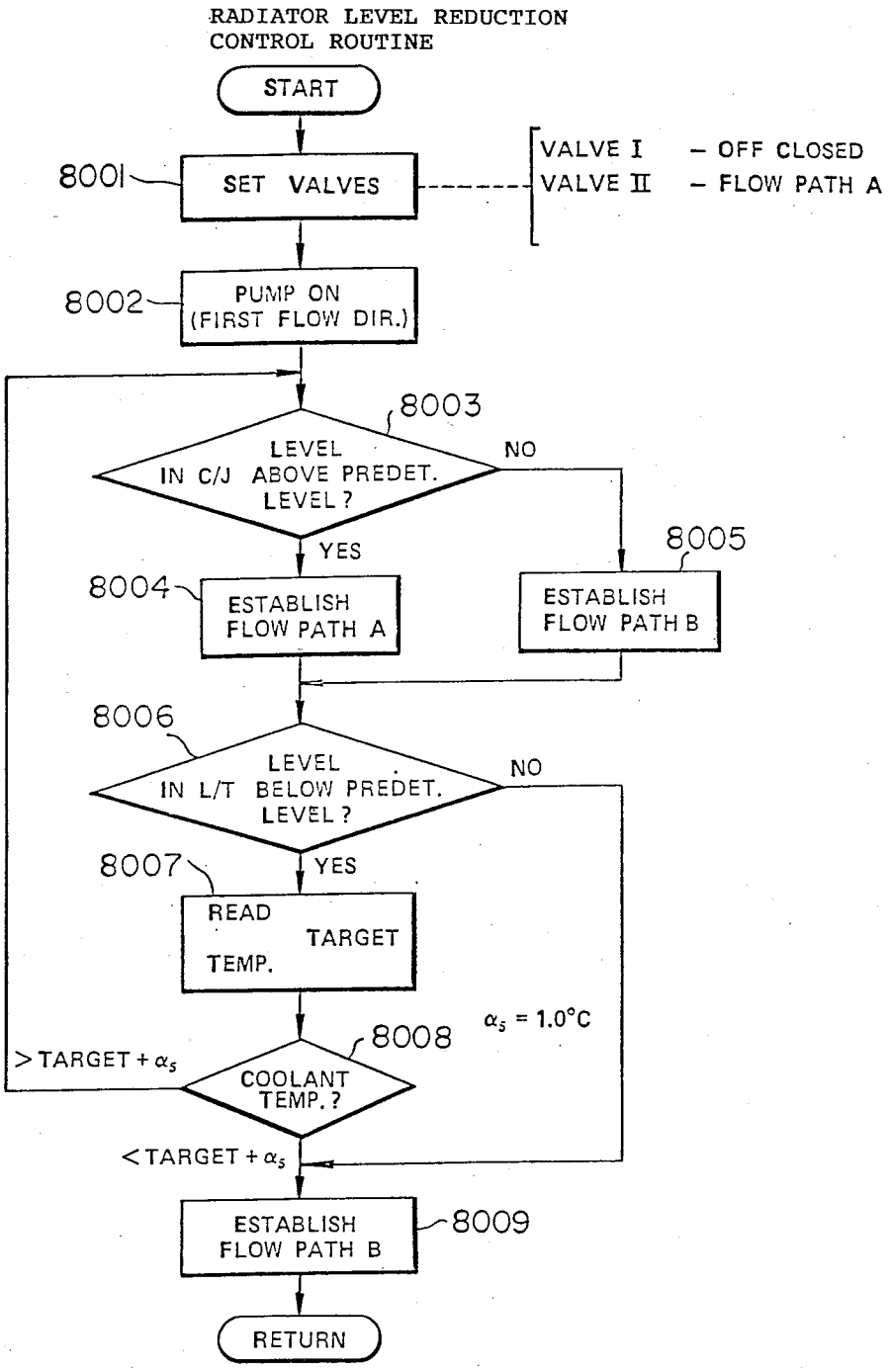

FIG. 16 shows in flow chart form the steps which characterize the control via which the level of coolant in the radiator is reduced for the purposes of coolant temperature control. As shown the first step (8001) of this control routine involves the conditioning of the valves so that valve I is closed and valve II establishes flow path A. At step 8002 pump 224 is energized so as pump coolant in the first flow direction (viz., from the lower tank toward valve II (236). Under these conditions coolant is withdrawn from the lower tank 220 and forced out to the reservoir 226 via conduit 238.

At step 8003 the coolant level in the coolant jacket 208 is checked to determine if the level of coolant therein has 'boiled down' to H1 or not. In the event that the level has not dropped to H1 then the program flows to step 8004 wherein the setting of valve II (236) is left as is and the flow path A maintained. On the other hand, if the level in the coolant jacket has in fact dropped to level H1 then as step 8005 the position of valve II is reversed to establish flow path B and thus terminate the discharge of coolant out of the system. Subsequently at step 8006 the coolant level in the lower tank 220 is determined by sampling the output of level sensor 262. In the event that the level of coolant in the lower tank is below level H2 then the program proceeds to step 8007 wherein the instant value of TARGET temperature is read out of RAM. However, if the level of coolant in the lower tank 220 is still above H2 then the program by-passes steps 8007 and 8008 as shown.

At step the instant coolant temperature is compared with the TARGET value obtained in step 8007. In the event that the coolant temperature is greater than TARGET+$\alpha 5$ (wherein $\alpha 5 = 1.0°$ C.) then the program returns to step 8003 in an effort to induce a further reduction in coolant and thus internal pressure while in the event that the coolant temperature is lower than TARGET+$\alpha 5$ then the program flows to step 8009 wherein flow path B is established via suitable conditioning of valve II.

As will be appreciated this control strives to lower the temperature of the coolant to a value which is within 1.0° C. of the desired TARGET value and is executed in response to the temperature ranging and level sensing steps 1007 and 1008 of the system control routine shown in FIG. 9.

RADIATOR LEVEL INCREASE CONTROL ROUTINE

Figure 17:
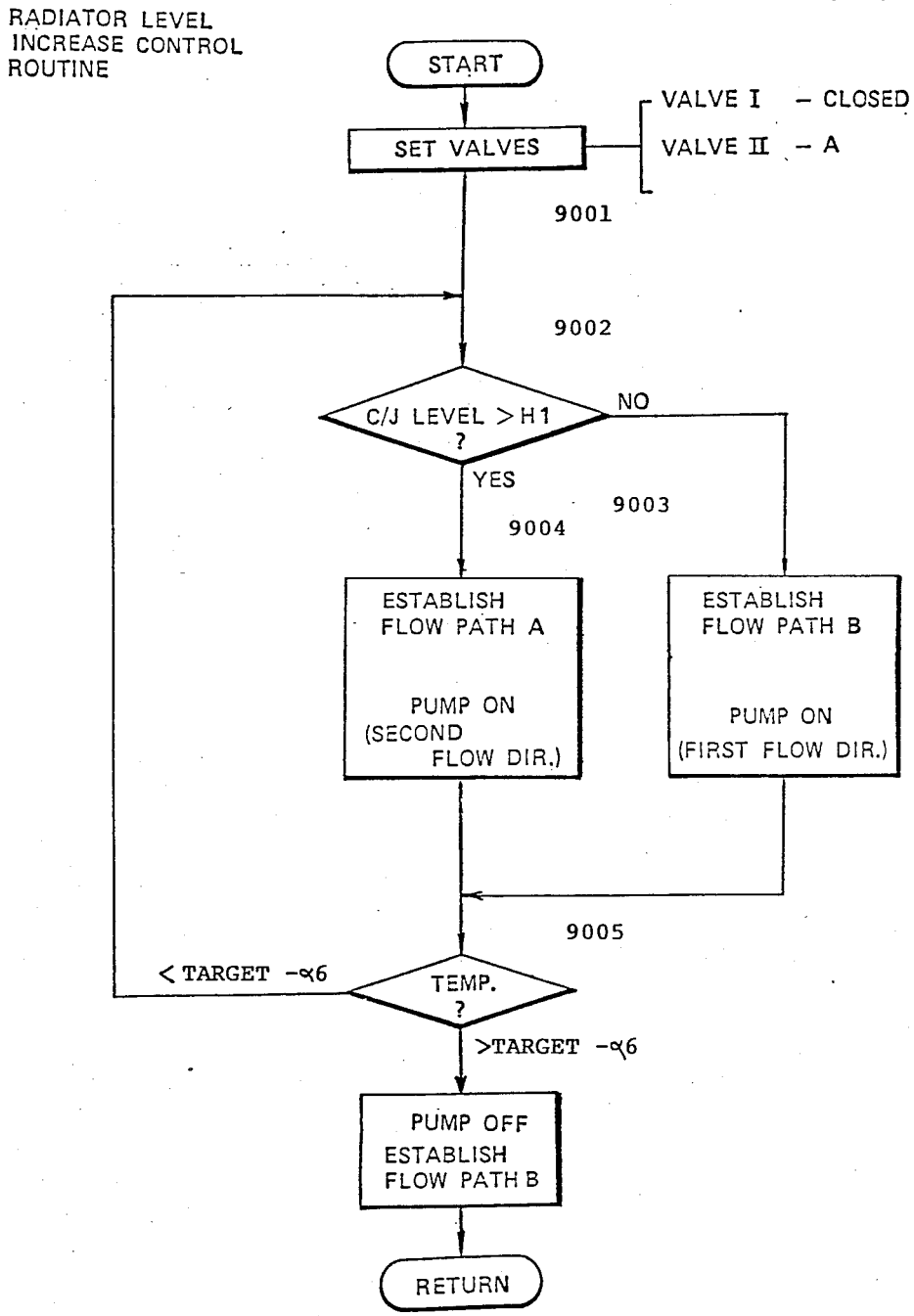

FIG. 17 shows in detail the steps which characterize the operation wherein the amount of coolant within the cooling circuit is increased in an effort to raise the pressure within the cooling circuit and thus raise the boiling point of the coolant. It will be noted that this control is executed in response to the temperature ranging executed in step 1007 of FIG. 9. which indicated that the coolant temperature was below TARGET−4° C.

As shown, at step 9001 the valves of the system are conditioned so that valve I is closed and valve II establishes flow path A. This of course conditions the system so that coolant may flow form the lower tank 220 the reservoir via conduit 238. At step 9002 the output of level sensor 252 is sampled and in the event that level of coolant in the coolant jacket 208 is below level H1 then at step 9003 valve II is switched to establish flow path B and the pump 224 is energized to pump in the first flow direction. This ensures that the vital level of coolant in the coolant jacket is ensured before proceeding with the steps of pumping from the reservoir 226 to the lower tank 220 are executed.

However, if the enquiry conducted at step 9002 reveals that sufficient coolant still remains in the coolant jacket then at step 9004 commands which condition vlave II to produce flow path A and to energize pump 224 in the reverse flow direction are issued. This conditions the system so that coolant is inducted and forced into the radiator thus increasing the level of liquid coolant therein and thus reducing the surface area available for the coolant vapor from the coolant jacket to release its latent heat of evaporation.

At step 9005 the temperature of the coolant is determined. In the event that the temperature is found to be less than TARGET$-\alpha 6$ (where $\alpha 6=2.0°$ C.) then the program flows back to step 9002 in an effort to introduce further coolant and thus induce a further increase in coolant temperature.

On the other hand, if the temperature is found to be greater than TARGET$-\alpha 6$ then at step 9006 commands to stop the operation of pump 224 and to establish flow path B are issued. Viz., as the temperature has been raised to within 2.0° C. Of the TARGET value then it is possible that the temperature control provided by the fan will be sufficient to bring the coolant temperature even closer to the required value. Accordingly, as the 'course' temperature control accorded by the level changing has been successful furthe application of the same is temporarily suspended pending the 'fine' control possible with fan 218.

SHUT-DOWN CONTROL ROUTINE

Figure 18:
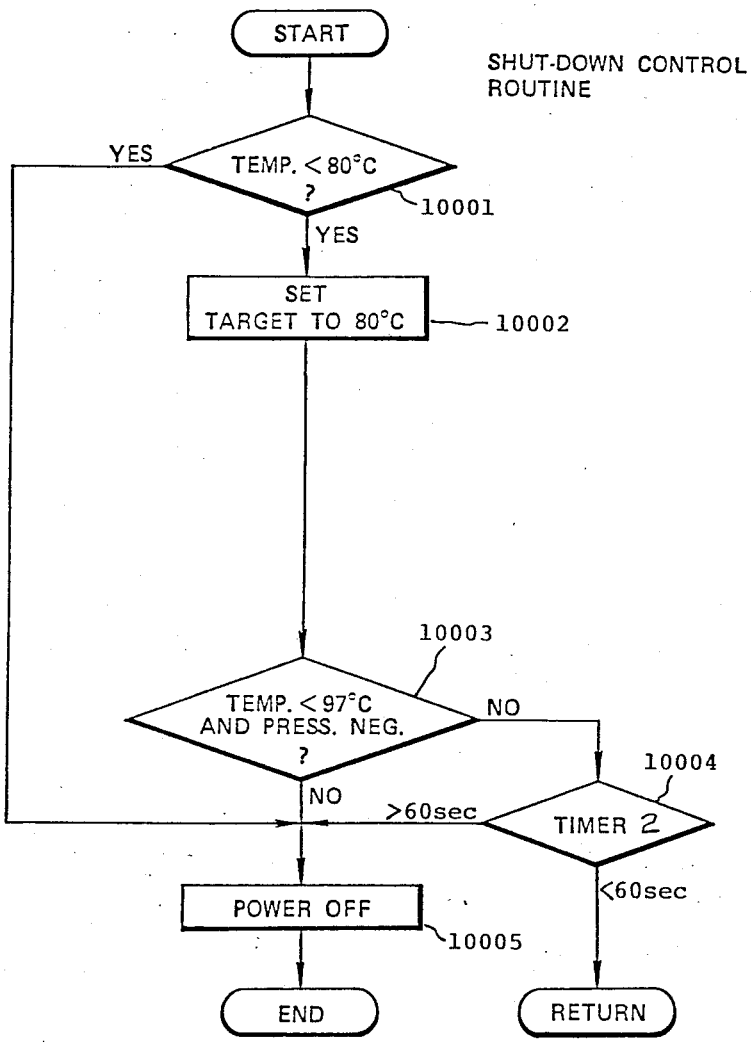

In the event that the engine is detect as having been stopped in step 2002 of the interrupt routine shown in FIG. 10, then as shown in FIG. 18 at step 10001 the output of temperature sensor 254 is sampled and the determination made if the instant coolant temperature is above 80° C. or not. In the event that the temperature is in fact lower than this crital level then the program immediately flows to step 10005 wherein power to the entire control system is terminated. However, in the event that the coolant is still 'hot' then at step 10002 the value of TARGET is set to the above mentioned value and at step 10003 it is determined if the temperature of the coolant is below 97° C. and the pressure prevailing in the cooling circuit is negative. In the instance where both of these conditions are simultaneously met the power to the system is cut-off. However, if either one of the requirements are not met then at step 10004 a soft clock is set counting for a period of 60 seconds (in this embodiment). Until this clock completes its count the program is induced to return.

Figure 19:
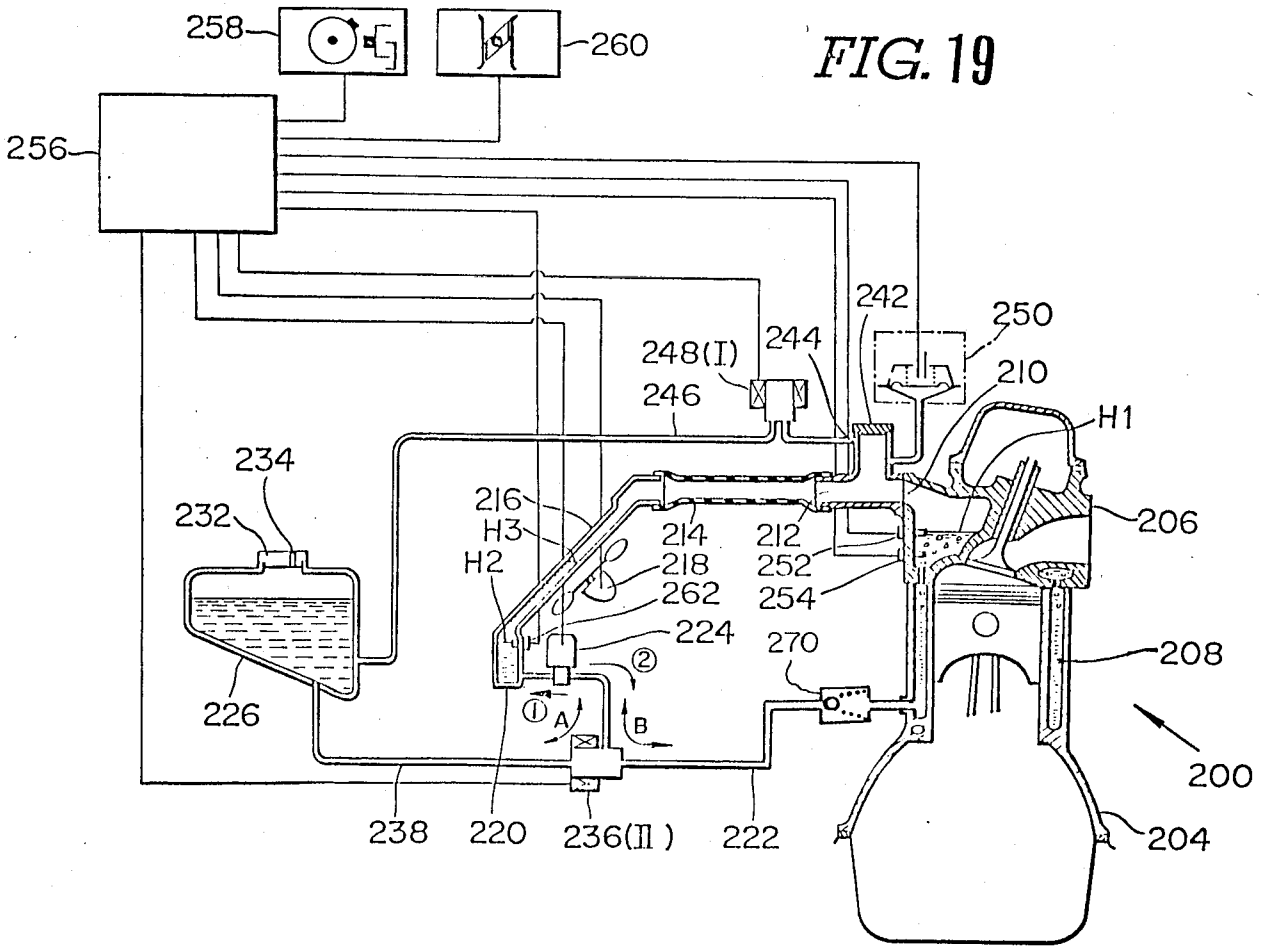
FIG. 19 shows a second embodiment of the present invention which features a slightly modified conduiting arrangement.

FIG. 19 shows a second embodiment of the present invention. This embodiment is basically similar to the first one shown in FIG. 8 but differs in that the coolant return conduit 222 rather than being connected to a port formed in the cylinder head is connected to one formed in the cylinder block.

With the arrangement of the first embodiment the head or pressure which tends to cause liquid coolant to flow from the coolant jacket back toward the pump 224 under the influence of gravity is relatively small. However, with the second embodiment the tendance for an undesirably back flow increases. Accordingly, it is deemed advantageous to dispose one-way check valve 270 in conduit 222 at a location between the coolant jacket and the pump 224. This provision overcomes the drawback that the pump will be frequently energized simply to replace the coolant which draining out of the cylinder head under the influence of gravity.

It will be noted that a cabin heating system can be readily adapated to the cooling system as described herein without difficulty.

What is claimed is:

1. In an internal combustion engine having a structure subject to high heat flux;

a cooling circuit for removing heat from said engine comprising:

(a) a coolant jacket formed about said structure, said coolant jacket being arranged to receive coolant in liquid form and discharge same in gaseous form, (b) a radiator in which the gaseous coolant produced in said coolant jacket is condensed to its liquid form, and (c) a vapor transfer conduit leading from said coolant jacket to said radiator for transfering gaseous coolant from said coolant jacket to said radiator;

a device associated with said radiator for varying the rate of heat exchange between said radiator and a cooling medium surrounding the radiator;

a liquid coolant return conduit leading from said radiator to said coolant jacket for returning coolant condensed to its liquid state in said radiator to said coolant jacket;

a reservoir the interior of which is maintained constantly at atmospheric pressure;

valve and conduit means for selectively interconnecting said reservoir and said cooling circuit, said valve and conduit means including a three-way valve disposed in said return conduit and a level control conduit leading from said three-way valve to said reservoir, said three-way valve having a first state wherein fluid communication between said radiator and said coolant jacket is interrupted and communication between said radiator and said reservoir established, and a second state wherein communication between said reservoir and said radiator is interrupted and communication between said radiator and said coolant jacket established;

a reversible pump disposed in said coolant return conduit at a location between said radiator and said three-way valve, said pump being selectively energizable to pump coolant in (a) a first flow direction from said radiator toward said three-way valve and (b) in a second flow direction from said three-way valve toward said radiator;

means for permitting liquid coolant to pass unrestrictedly through said pump when the pump is not pumping;

a first sensor for sensing a parameter which varies with the temperature of the liquid coolant in said coolant jacket;

a second sensor for sensing a parameter which varies with the load on the engine; and a control circuit responsive to said first and second sensors for controlling the operation of said device, said valve and conduit means and said pump, said control circuit including means for:

determining the operational mode of the engine;

deriving a target temperature at which the liquid coolant in said coolant jacket should be maintained;

operating said device in a manner to vary the rate of condensation in said radiator and bring the temperature of the coolant in said coolant jacket to said target temperature, operating said three-way valve in a manner to establish fluid communication between said reservoir and said cooling circuit when the engine is stopped and the temperature of the coolant in said cooling circuit is below a predetermined level, so that liquid coolant can be inducted from said reservoir into said cooling circuit via said permitting means, and so that liquid coolant can be displaced from said cooling circuit to said reservoir via said permitting means when the engine is warming up after being started; and operating said three-way valve and said pump in a manner to vary the amount of coolant in said cooling circuit and therefore modify the pressure prevailing in said cooling circuit in a manner which tends to being the temperature of the coolant to said target temperature.

2. An internal combustion engine as claimed in claim 1, wherein said valve and conduit means further comprises:

an overflow conduit which fluidly communicates with said cooling circuit at a first end thereof and with said reservoir at a second end thereof;

a second valve disposed in said overflow conduit, said second valve having a first position wherein fluid communication between said cooling circuit via said overflow conduit is prevented and a second position wherein fluid communication between said cooling circuit and said radiator via said overflow conduit is permitted.

3. An internal combustion engine as claimed in claim 1 further comprising;

means responsive to the pressure differential between the interior and exterior of said cooling circuit, said pressure differential means being arranged to output a signal indicative of a predetermined pressure differential existing betweem the interior and exterior of said cooling circuit.

4. An internal combustion engine as claimed in claim 1 wherein said engine includes:

a cylinder block;

a cylinder head detachably secured to said cylinder block;

means defining cavities in said cylinder head and cylinder block which cavities define said coolant jacket; and wherein said liquid coolant return conduit communicates with a cavity formed in said cylinder head.

5. An internal combustion engine as claimed in claim 1 wherein said engine includes:

a cylinder block;

a cylinder head detachably secured to said cylinder block;

means defining cavities in said cylinder head and cylinder block which cavities define said coolant jacket; and wherein said liquid coolant return conduit communicates with a cavity formed in said cylinder block and which further comprises:

a one-way check valve disposed in said liquid return conduit at a location between said three-way valve and said cylinder block, said one-way valve being arranged to prevent the flow of liquid coolant from said coolant jacket toward said three-way valve.

6. A method of cooling an internal combustion engine comprising the steps of:

introducing liquid coolant into a cooling circuit which includes a coolant jacket formed about structure of the engine subject to high heat flux;

permitting the coolant in said coolant jacket to boil and produce coolant vapor;

transferring the coolant vapor to a radiator which defines a further section of said cooling circuit;

condensing the coolant to its liquid form in said radiator;

sensing operational parameters of said engine;

sensing the temperature of the coolant in said coolant jacket;

using the data obtained during said step of sensing operational paramters to derive a target temperature at which the coolant in said coolant jacket should be maintained under the instant set of operational conditions;

using a device located externally of said radiator to vary the rate of heat exchange between the radiator and a cooling medium surrounding said radiator in a manner which tends to bring the temperature of said coolant to said target temperature;

using a reversible pump to pump coolant into and out of said coolant circuit in a manner which varies the pressure prevailing in said cooling circuit in a manner which tends to bring the temperature of said coolant to said target temperature;

storing liquid coolant in a reservoir; and permitting liquid coolant to pass unrestrictedly through said reversible pump from said reservoir to said cooling circuit and vice versa under the influence of a pressure differential which exists betwen said cooling circuit and said reservoir when the pump is not pumping.

7. A method as claimed in claim 6, further comprising the step of performing said step of permitting when the temperature of said coolant is below a predetermined level when the engine is stopped or when the engine is warming-up after being started.

* * * * *